United States Patent [19]

Tellie

[11] 3,938,422

[45] Feb. 17, 1976

[54] AUTOMATIC FIREARMS HAVING A BOLT ASSISTED BY AN ADDITIONAL MASS

[76] Inventor: Paul E. Tellie, 20, rue Bergson, 42000 St Etienne, France

[22] Filed: May 17, 1974

[21] Appl. No.: 470,839

[30] Foreign Application Priority Data

June 1, 1973 France ..... 73.19974

[52] U.S. Cl. ..... 89/169; 89/1 K

[51] Int. Cl.[2] ..... F41D 5/02; F41D 11/00

[58] Field of Search ..... 89/169, 1 K

[56] References Cited

UNITED STATES PATENTS

| | | | |
|---|---|---|---|
| 830,511 | 9/1906 | Lehmann | 89/169 |
| 1,985,493 | 12/1934 | Gebauer et al. | 89/169 |
| 2,459,141 | 1/1949 | Balleisen | 89/169 |
| 2,503,575 | 4/1950 | Anderson et al. | 89/169 |

*Primary Examiner*—Samuel Feinberg
*Assistant Examiner*—C. T. Jordan
*Attorney, Agent, or Firm*—Stevens, Davis, Miller & Mosher

[57] ABSTRACT

An automatic firearm having a bolt which recoils upon each shot and an additional mass mounted for sliding parallel to the bolt and fastened to the bolt by an amplifying lever which is pivotally mounted on the bolt by a transverse pin and which has a resting surface adapted to come into contact with a stop surface which is stationary at the start of the recoil of the bolt. The amplifying lever is H-shaped. The cross bar of the H constitutes the transverse axis of pivoting of the assembly of the lever and the two vertical uprights constitute two symmetrical unit amplifying levers operating in parallel each capable of assuring a proper fastening together of the bolt and the additional mass. The assembly of the amplifying lever has complete symmetry with respect to the central plane perpendicular to its axis of pivot and lends itself to continuation of the firing in case of the breaking of one of the unit amplifying levers. The amplifying lever has a resting surface directed toward the rear adapted, upon the start of the recoil of the bolt, to come into contact with a stop surface rigidly fastened to a fixed portion of the firearm so as to impart to the amplifying lever a tilting movement which has the effect of accelerating the additional mass towards the rear. The arrangement imparts to the resting surface and the stop surface the shape of cylindrical sections of the same radius of curvature, so that the resting surface and stop surface cooperate by area contact when the recoil movement of the bolt commences.

11 Claims, 3 Drawing Figures

AUTOMATIC FIREARMS HAVING A BOLT ASSISTED BY AN ADDITIONAL MASS

Figure 1:
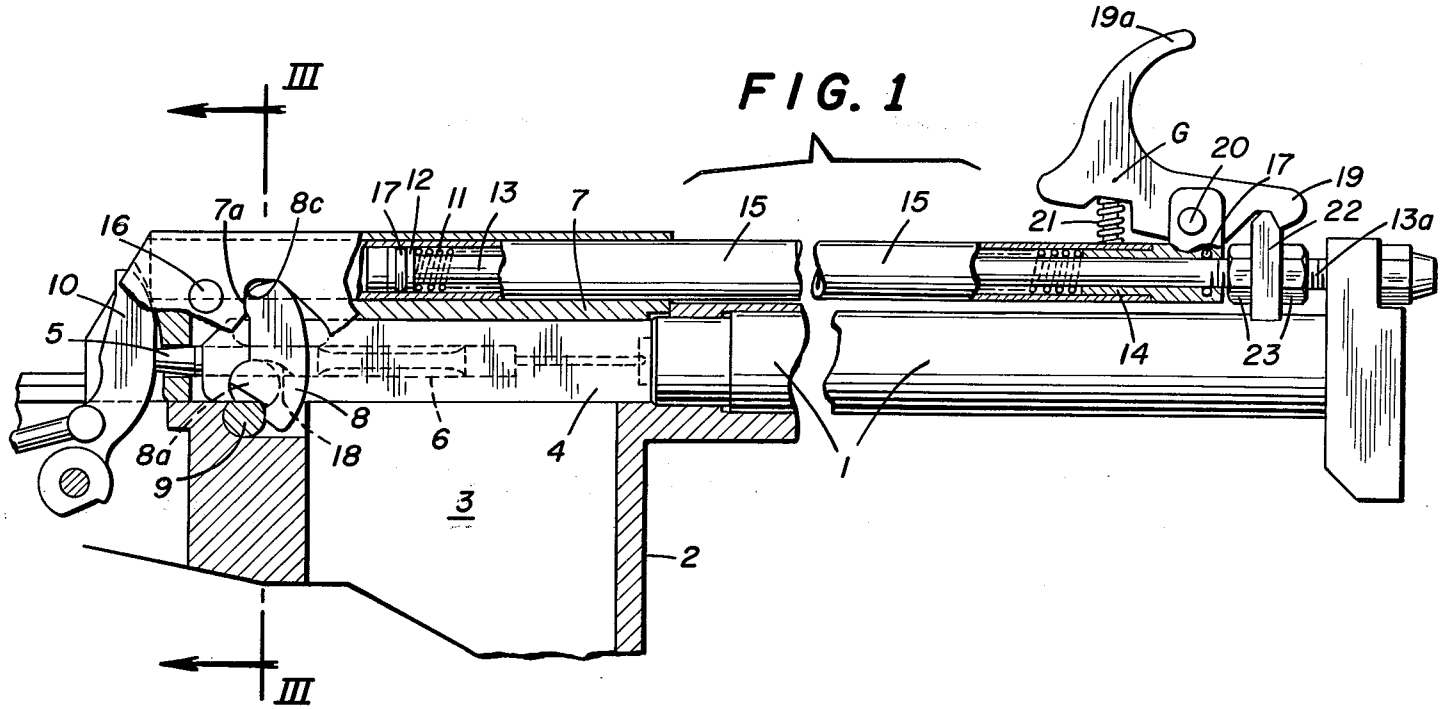

The present invention relates to automatic firearms the bolt mechanism of which comprises, in addition to a bolt which moves back upon each shot against the action of return means, an additional mass attached to said bolt via an amplifying lever which, upon the recoil of the bolt, imparts to said additional mass a speed of recoil which is higher than that of the said bolt, the imparting of this speed to the said additional mass having the effect of braking the recoil of the bolt (at least at the start of its recoil stroke) in proportions which are an increasing function of the value of the additional mass and the multiplication factor introduced by the amplifying lever.

The invention relates more particularly, since it is in this case that its application seems to be of the greatest advantage, but not exclusively, among automatic firearms of this type, to those of small caliber, and in particular those of the assault rifle or machine pistol type.

Experience has shown that the life of the bolt mechanism of this type of firearm depends to a large extent on the life of the amplifying lever and the stresses produced by said lever in the two parts with which it cooperates, namely the bolt and the additional mass associated with said bolt.

The object of the invention is specifically to provide a firearm of the type in question which is of increased life, this improvement resulting both from a modification in the structure of the amplifying lever proper and of an improved arrangement of the kinematic assembly consisting of the said amplifying lever and the various parts with which it cooperates (in particular the bolt and the additional mass).

The automatic firearm in accordance with the invention comprises, among other parts, a bolt which recoils upon each shot against the motion of return means and an additional mass mounted for sliding parallel to said bolt and fastened to said bolt via an amplifying lever which is pivotally mounted on the said bolt by a transverse pin and which has a resting surface adapted to come into contact with a stop surface which is stationary at the start of the recoil stroke of the bolt. The automatic firearm is characterized by the fact that its amplifying lever, seen in the direction of the axis of firing, has the shape of an H the horizontal cross bar of which constitutes the transverse axis of pivoting of the assembly of the lever in question and whose two vertical uprights constitute two symmetrical unit amplifying levers operating in parallel and each capable of assuring a proper fastening together of the bolt and the additional mass, due to which the assembly of the amplifying lever has complete symmetry with respect to the central plane perpendicular to its axis of pivot (elimination of any transverse tilting moment) and lends itself to continuation of the firing in case of the accidental breaking of one of the said unit amplifying levers.

Another arrangement of the invention, which is independent of the preceding one, relates to an automatic firearm with a recoiling bolt fastened to an additional mass by an amplifying lever having a resting surface which is directed towards the rear and adapted, upon the start of the recoil stroke of the bolt, to come into contact with a stop surface rigidly fastened to a fixed portion of the firearm so as then to impart to said amplifying lever a tilting movement which has the effect of accelerating the additional mass towards the rear, the said arrangement consisting of imparting to the said resting surface and the said stop surface the shape of cylindrical sectors of the same radius of curvature, so that these two elements (resting surface and stop surface) cooperate by area contact (in opposition to linear contact) when the recoil movement of the bolt commences, that is to say, when the rearward directed force applied to said bolt is maximum.

This arrangement makes it possible to reduce the specific pressures produced on the amplifying lever when its resting surface strikes against the fixed stop surface and thus at the same time reduce the risks of the said amplifying lever jamming.

Another arrangement of the invention, which is also independent of the preceding ones, concerns the resultant of the forces acting on the bolt at the start of the recoil stroke.

In accordance with this latter arrangement, in a firearm with a recoiling bolt fastened to an additional mass by an amplifying lever pivotally mounted on the bolt by a transverse pin and having a resting surface adapted to come into contact with a fixed stop surface at the start of the recoil stroke of the bolt, the relative positions of the front resting surface of the bolt on the cartridge in firing position, of the transverse pivot axis of the amplifying lever and of the two resting surfaces via which the said amplifying lever cooperates with the fixed stop surface and with the additional mass respectively are determined in such a manner that, at least at the start of the recoil stroke of the bolt (that is to say, when the pressures in the barrel of the firearm reach the highest values), the resultant of the forces produced on the bolt by the cartridge which has just been fired, by the additional mass and by the fixed portion of the firearms tends to flatten the rear portion of the bolt against the guide members of the bolt which are borne by the breech box, due to which the guiding of the bolt is improved, and the various plays of the bolt mechanism are constantly taken up in the same direction, all points contributing to assuring a constant amplification ratio and therefore uniformity of the firing.

This latter arrangement can advantageously be employed, from a structural standpoint:

— by locating the bolt guide members at the level of the floor of the breech box, — by locating the transverse pivot axis of the amplifying lever below the axis of firing, — by causing the upper arm of the amplifying lever to cooperate with the additional mass by the resting of a convex protuberance forming part of said lever against a flat resting surface, perpendicular to the axis of firing, forming part of the said additional mass, — by causing the lower arm of the amplifying lever to bear the resting surface which is to cooperate at the start of the recoil stroke of the bolt with the fixed stop surface, — and by so shaping the zone of contact of the resting surface and the stop surface that the reaction exerted by the stop surface on the resting surface is directed horizontally or downward, but in no case upward.

In accordance with still another arrangement of the invention which is independent of the preceding ones, the amplifying lever of firearms of the type in question as well as the fixed stop surface with which the said amplifying lever cooperates at the start of the recoil stroke of the bolt are located to the rear of the cage intended to receive the clip of the firearm, which leads to a decrease in the frictional forces and greater uniformity of operation of the bolt mechanism of the firearm.

In accordance with still another arrangement of the invention which is independent of the preceding ones, the bolt of firearms of the type in question is guided, at the start of its recoil stroke, by resting surfaces located to the front and to the rear respectively of the cage intended to receive the clip of the firearm.

In accordance with still another arrangement of the invention which is independent of the preceding ones, the amplifying lever of the bolt mechanism of the firearm constitutes a rear retaining stop for the firing pin housed in the bolt, due to which firing is made impossible if one has forgotten to put the amplifying lever in place upon assemblying the said bolt mechanism.

In accordance with still another arrangement of the invention which is independent of the preceding ones, he recoiling portions of the bolt mechanism of firearms of the type in question are subjected to the action of elastic return means formed of a recoil spring housed in a housing which is slidably mounted on a guide rod which is integral with the barrel of the firearm and removably fastened to the additional mass forming part of the bolt mechanism due to which on the one hand the said return means can be lubricated once and for all and on the other hand the return means in question can remain on the firearm in case of the removal of the bolt mechanism.

Finally, in accordance with another arrangement of the invention, firearms of the type in question are provided with a recocking rod borne by the additional mass of the bolt mechanism of the firearm and having a spring pivoting hook adapted to cooperate, at the end of the closing stroke of the additional mass, with a stop which is rigidly connected with the barrel of the firearm. The hook and the stop cooperate by contact between inclined resting surfaces so arranged (with respect to their sizes and inclinations) that, with due consideration of the force of the spring of the hook, on the one hand, this hook remains in hooked position, despite the rebound forces acting on the additional mass upon its arrival into closing position, and, on the other hand, the hook frees itself from its support under the effect of the recoil force (which is far greater than the said rebound forces) produced by the firing of a cartridge.

This latter arrangement may advantageously be employed by arranging the hook in question in such a manner that the position of its center of gravity, in case of commencement of rebound of the additional mass, favors the tilting of the hook, by momentum, in the direction of hooking, which makes it possible to reduce the force of the hook return spring.

The hook in question can then advantageously be arranged in the form of a recocking member the release of which, taking place before the recocking maneuver proper, requires only a reduced force, since the force of the return spring for said hook is itself small.

Figure 2:
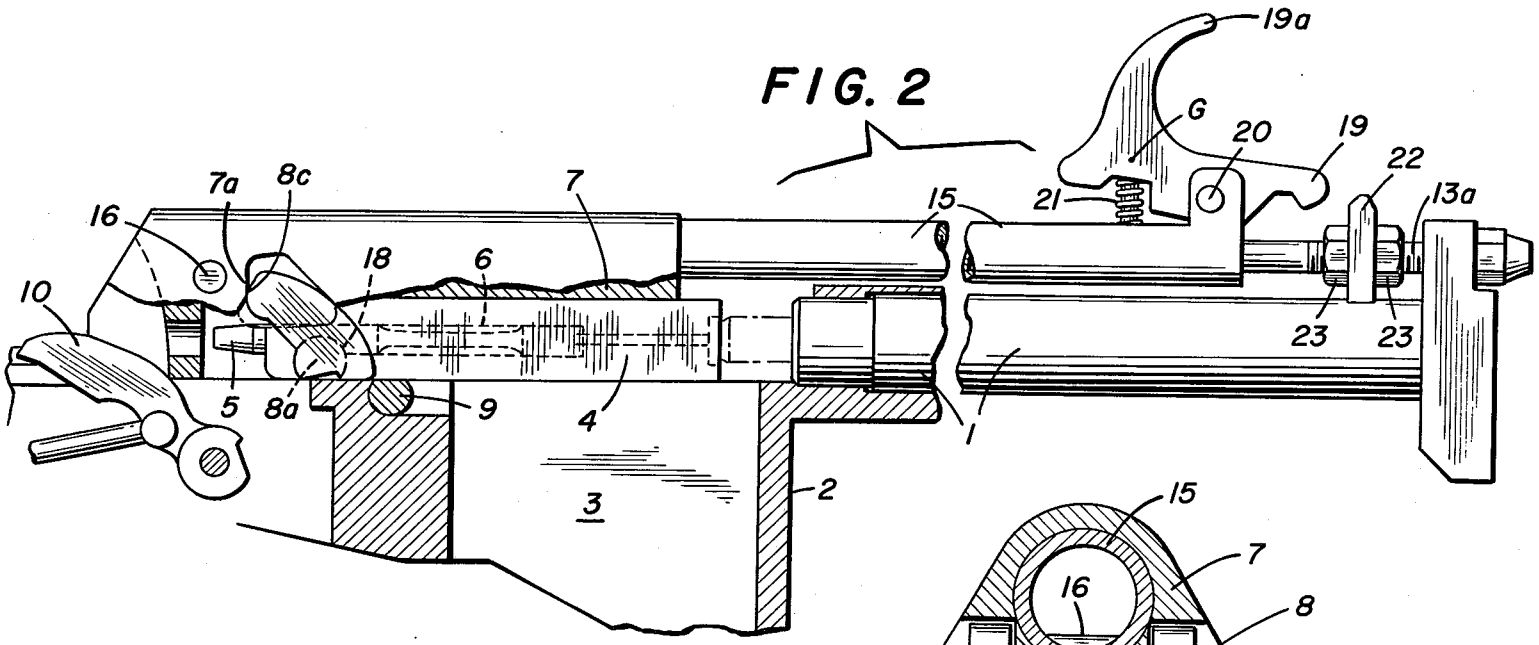
Figure 3:
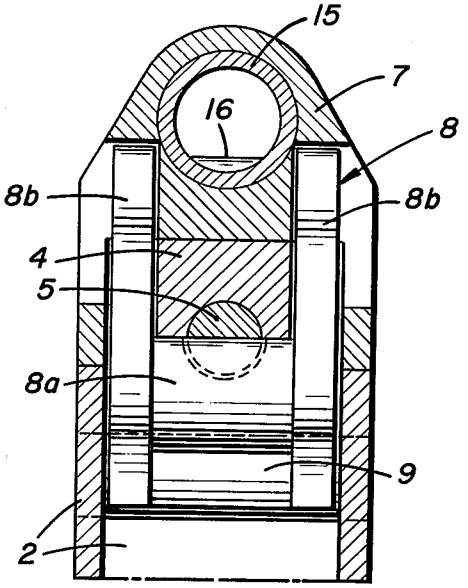

In order to illustrate the various arrangements indicated, a preferred (not not limitative) embodiment of the invention will now be described with reference to the accompanying drawings in which:

— FIG. I shows, in elevation, with portions cut away and portions removed, an assault rifle developed in accordance with the invention, this firearm being shown with its bolt closed, — FIG. 2 shows the same assault rifle in the same manner, but this time with its bolt open, — and FIG. 3 finally is a cross section on a larger scale along the line III—III of FIG. 1.

The assault rifle shown in FIGS. 1 to 3 comprises a launching tube 1 rigidly connected with a bolt box 2 in which there is provided a cage 3 for the insertion of a clip.

The bolt mechanism of this assault rifle comprises essentially:

a movable bolt 4 mounted for longitudinal sliding in the bolt box 2 and resting on two resting surfaces located on the floor of its housing at the front and the rear of the cage 3, a firing pin 5 mounted for longitudinal sliding in an axial recess 6 provided in the bolt 4 and permitting the release of the firing pin 5 towards the rear, an additional mass 7 mounted for longitudinal sliding on the bolt 4, in the bolt box 2, said mass being fastened to said bolt by an amplifying lever 8 which is articulated, by means of a transverse pin 8*a*, on the said bolt 4 in a region of the latter located to the rear of the clip cage 3, a stationary rear retention stop 9 arranged on the path of recoil of the lower arm of the amplifying lever 8, the contact surfaces of the stop 9 and the arm having the shape of a cylindrical sector, the bisecting plane of which is horizontal when the bolt is closed (as in the case of FIG. 1), a pivoting percussion hammer 10 adapted to cooperate with the firing pin 5 when the bolt 4 arrives in position, and a recoil spring 11 urging the bolt 4 and the additional mass 7 towards their closed position, said spring being interposed between on the one hand a rear stop 12 provided at the rear end and serving as guide for the said spring 11, and on the other hand a front stop 14 rigidly connected with a tubular element 15 fastened to the additional mass 7 by a removable transverse pin 16, the tubular element 15, which is guided at its ends by the rod 13, acting both as air-tight box for the recoil spring 11 (due to the sealing joints 17 provided at the ends of the rod 13) and as recocking rod, as will be more expressly indicated below.

In FIG. 3 there is shown on a larger scale the amplifying lever 8 which, seen in the direction of the axis of firing, has the shape of an H the cross bar of which, located below the axis of the tube 1, constitutes the pivot pin 8a of the said lever 8 and the uprights 8b of which constitute two identical unit amplifying levers resting via a convex protuberance 8c provided at their upper end against a flat resting surface 7a belonging to the additional mass 7 and oriented perpendicular to the axis of firing.

With such a bolt mechanism, the resultant of the forces acting on the bolt 4 at the start of its opening stroke tends to bring the said bolt against the floor of the bolt box 2.

Moreover, the pivot pin 8*a* of the amplifying lever 8 is engaged transversely in a longitudinal groove 18 provided in the firing pin 5, the pivot pin 8*a* preventing the escape of the firing pin 5 towards the rear when the lever 8 is in place.

Finally, in order to prevent the rebound of the additional mass 7 upon closing and in order to permit the actuation of the recocking rod 15, there is provided at the front end of the said rod 15 a hook 19 articulated on a transverse pin 20 and subjected to the action of a spring 21 which tends to cause it to swing in such a manner that at the end of the closing of the additional mass, it comes over a hooking stop 22 which is rigidly connected with the barrel 1 of the firearm. The hook 19 and the stop 22 cooperate by means of inclined resting surfaces which remain in contact when rebound forces appear, but permit the release of the hook under the effect of the recoil forces, which are far greater than the rebound forces, applied to the moving portions of the bolt mechanism upon the firing of the shot.

The hook 19 is provided on its top with a recocking lever 19*a* and the center of gravity G of the pivoting assembly formed by the hook and the lever is located above the axis of pivot 20 so that, in case of commencement of rebound of the additional mass 7, the angular momentum of the said pivoting assembly tends to hold it in hooked position.

It should be noted that the hooking stop 22 may advantageously be adjustable longitudinally by having it borne by a thread 13*a* provided at the front end of the rod 13 and by providing two locking nuts 23 on said thread 13a on opposite sides of the stop 22.

As goes without saying and is furthermore already evident from the foregoing, the invention is by no means limited to those of its methods of application and embodiments which have been more particularly contemplated; rather, it covers all variants.

What is claimed is:

1. An automatic firearm comprising:

a bolt which recoils upon each slot against the action of return means, an additional mass, an amplifying lever pivotally mounted on said bolt by a transverse pin, said amplifying lever having a resting surface adapted to come into contact with a fixed stop surface at the start of the recoil stroke of the bolt, said additional mass being mounted for sliding parallel to said bolt and being fastened to said bolt by said amplifying lever, and said amplifying lever, in the direction of the axis of firing, being symmetrical with respect to a central plane perpendicular to its axis of pivot and being in the shape of an H the horizontal cross bar of which is said transverse pin and the two uprights of which are two symmetrical parallel unit amplifying levers each capable of assuring a correct fastening of the bolt and the additional mass so that firing may be continued upon breaking of one of the two unit amplifying levers.

2. An automatic firearm comprising:

a recoiling bolt, an additional mass, a stop surface rigidly fastened to a fixed portion of the firearm, an amplifying lever having a resting surface directed towards the rear and adapted to come into contact, at the start of the recoil stroke of the bolt, with said stop surface rigidly fastened to a fixed portion of the firearm so as to impart to said amplifying lever a tilting movement having the effect of accelerating said additional mass towards the rear, said recoiling bolt being fastened to said additional mass by said amplifying lever, and said resting surface and said stop surface having the shape of cylindrical sectors of the same radius of curvature so that the resting surface and the stop surface cooperate by area contact when the recoil movement of the bolt commences when the rearward-directed force applied to the bolt is maximum.

3. An automatic firearm comprising:

a recoiling bolt, said bolt having a front resting surface, an additional mass, a fixed stop surface, an amplifying lever pivotally mounted on said bolt by a transverse pivot pin, said amplifying lever having a resting surface adapted to come into contact with said fixed stop surface at the start of the recoil stroke of the bolt, said recoiling bolt being fastened to said additional mass by said amplifying lever, a bolt box, said bolt box having guide members for said bolt, and the relative positions of the front resting surface of the bolt on a cartridge in firing position, of the transverse pivot pin, of the amplifying lever, and of the resting surface by which the amplifying lever cooperates with the fixed stop surface and with the additional mass respectively are such that, at least at the start of the recoil stroke of the bolt, the resultant of the forces produced on the bolt by the cartridge which has just been fired, by the additional mass, and by the fixed stop surface tends to bring the rear portion of the bolt against the guide members, whereby guiding of the bolt is improved and different plays are constantly taken up in the same direction for assuring a constant ratio of amplification of the amplifying lever and therefore uniformity of firing.

4. An automatic firearm as claimed in claim 3, wherein:

said bolt box has a floor and the guide members are at the level of the floor, the transverse pivot pin of the amplifying lever is below the firing axis of the firearm, said additional mass has a flat resting surface perpendicular to the axis of firing, said amplifying lever has an upper branch and a convex protuberance, and the upper branch cooperates with said additional mass by the resting of said convex protuberance against said flat resting surface, said amplifying unit has a lower branch, and the lower branch bears said resting surface, and the contact area of said resting surface and said stop surface are shaped so that the reaction exerted by said stop surface on said resting surface is not directly upward.

5. An automatic firearm comprising:

a recoiling bolt, an additional mass, an amplifying lever, said recoiling bolt being fastened to said additional mass by said amplifying lever, a fixed stop surface, a cage for receiving a clip of the firearm, said amplifying lever cooperating with said fixed stop surface at the start of the recoil stroke of the bolt, and said amplifying lever and said fixed stop surface being to the rear of the cage so as to decrease frictional forces and for increasing the regularity of operation with the firearm.

6. An automatic firearm comprising:

a recoiling bolt,
an additional mass,
an amplifying lever,
said recoiling bolt being fastened to said additional mass by said amplifying lever,
a cage for receiving a clip of the firearm, and
resting surfaces to the front and rear respectively of the cage for guiding the bolt at the start of its recoil stroke.

7. An automatic firerarm comprising:
a recoiling bolt,
a firing pin housed in the bolt,
an additional mass,
an amplifying lever,
said recoiling bolt being fastened to said additional mass by said amplifying lever, and
said amplifying lever being a rear retention stop for the firing pin whereby firing is made impossible if one has forgotten to put the amplifying lever in place.

8. An automatic firearm comprising:
a recoiling bolt,
an additional mass,
an amplifying lever,
said recoiling bolt being fastened to said additional means by said amplifying lever,
said bolt, mass, and lever being a movable unit,
a barrel,
a guide rod rigidly connected with the barrel and removably fastened to the additional mass,
an airtight housing slidably mounted on the guide rod,
a recoil spring housed in said housing, and
said movable unit being biased by said recoil spring whereby said recoil spring need only be lubricated once and said recoil spring can remain on the firearm.

9. An automatic firearm comprising:
a recoiling bolt,
an additional mass,
an amplifying lever,
said recoiling bolt being fastened to said additional means by said amplifying lever,
a recocking rod, said recocking rod having a pivoting hook, said hook having an inclined resting surface, said hook being biased by a spring,
a barrel,
a stop rigidly connected with the barrel, said stop having an inclined resting surface, and
said pivoting hook being adapted to cooperate, at the end of the closing stroke of the additional mass, with said stop, said hook and said stop cooperating by contact between their respective inclined resting surfaces so that said hook remains in a hooked position despite the rebound forces acting on the additional mass upon its arrival into closed position and so that said hook is released from its rest under the effect of the recoil force, which is far greater than the rebound forces, produced by the firing of a cartridge.

10. An automatic firearm as claimed in claim 9, wherein:
said hook is positioned with its center of gravity so that, upon initiation of rebound of the additional mass, the hook pivots by momentum in the direction of hooking so that it is possible to reduce the spring force of the spring.

11. An automatic firearm as claimed in claim 10, wherein:
said hook is a recocking member the release of which, taking place before recocking, requires only a small force since the spring force of the spring is small.

* * * * *